US005895199A

United States Patent [19]

Baumert, III et al.

[11] Patent Number: 5,895,199

[45] Date of Patent: Apr. 20, 1999

[54] APPARATUS FOR COUPLING A FRONT END LOADER TO A TRACTOR

[75] Inventors: Oscar J. Baumert, III, Landisville; Kevin W. Ward; Jay K. Horst, both of Lititz, all of Pa.; Richard L. Yohn, Brunswick, Ga.

[73] Assignee: New Holland North America, Inc., New Holland, Pa.

[21] Appl. No.: 08/909,406

[22] Filed: Aug. 11, 1997

[51] Int. Cl.[6] ..... E02F 3/627

[52] U.S. Cl. ..... 414/686; 172/275

[58] Field of Search ..... 414/685–686; 172/272–275

[56] References Cited

U.S. PATENT DOCUMENTS

| | | | |
|---|---|---|---|
| 3,606,052 | 9/1971 | Schurz . | |
| 4,621,973 | 11/1986 | Langenfeld | 414/686 |
| 4,810,162 | 3/1989 | Foster | 414/723 |
| 4,884,940 | 12/1989 | Steinkamp et al. | 414/715 |

OTHER PUBLICATIONS

New Holland North America, Inc. 1995 Publication No. 31721080 * 89550.API entitled "Ford Front–end Loaders".

New Holland North America, Inc. 1996 Catalog No. 41645800 entitled Installation Instruction Mount Kit #9863872.

*Primary Examiner*—Donald W. Underwood
*Attorney, Agent, or Firm*—Larry W. Miller; Frank A. Seemar; J. William Stader

[57] ABSTRACT

Apparatus for coupling a front end loader to a tractor comprising a longitudinally extending loader mounting frame for pivotally supporting a pair of loader boom arms. The frame comprises a pair of transversely spaced support arms, and a pair of forwardly extending members affixed to the support arms. A pair of front mounting pins extend from the tractor for coupling the forwardly extending members of the frame to the front of the tractor. A pair of rear mounting pins extending from the tractor, cooperate with a latch assembly for coupling each transversely spaced support arm to a corresponding mounting pin under conditions where the forwardly extending members are coupled to the tractor. The latch assembly includes a notch in each of the support arms for receiving a mounting pin and a latch plate for holding the pin in the notch under conditions where the pin is received by the notch. The latch plate is pivotally mounted on the support arm for automatic movement between open and closed positions under conditions where the mounting pin is received by the notch. A translatable holding rod moves from a disengaged position to an engaged position for holding the latch plate in the closed position.

10 Claims, 6 Drawing Sheets

APPARATUS FOR COUPLING A FRONT END LOADER TO A TRACTOR

FIELD OF THE INVENTION

The present invention relates generally to front loaders and more particularly to apparatus for coupling a loader to the front end of a tractor.

BACKGROUND OF THE INVENTION

Over the years it has been common for tractors to carry loaders to which a variety of attachments can be connected for a wide range of material handling applications in the industrial, agricultural and construction fields. Such loaders, usually mounted on the front end of a tractor, generally include a frame assembly, boom arms pivotally mounted on the frame, an attachment mounted across the forward ends of the boom arms, tilt cylinders coupled between the attachment and the boom arms, and lift cylinders coupled between the boom arms and the frame assembly. U.S. Pat. No. 4,884,940, issued Dec. 5, 1989 in the name of John O. Steinkamp, et al, is exemplary of a prior art tractor having a front end loader of this nature. In construction applications it is common to provide a tractor with a conventional loader attached to the front end while an excavating implement is also attached to the back end as shown in U.S. Pat. No. 4,810,162, issued Mar. 7, 1989 in the name of Derek K. Foster. In many other applications, the tractor includes a three point hitch for operating farm implements attached to the rear end.

Regardless of the application, in many instances it is desirable for front loaders to be removable because, even though other implements can be used while the loader is attached to the front end, handling and maneuverability of the tractor are usually enhanced with the loader removed. Thus, it is incumbent for a tractor to readily convert between a material handling vehicle with a front loader to a vehicle with an implement operative via a three point hitch, e.g., a mower. This frees up the tractor for performing tasks that can best be accomplished without the loader mechanism extending from the front. Brochure No. 31721080.89550.API, published by New Holland North America, Inc. in 1995, shows various front end loaders that are detachable from the tractor on which they are mounted.

As mentioned above, a variety of attachments, such as scoops, blades, forks, grapples and bale spears, can be utilized on front loaders. Regardless of the attachment, there is a need to attach and remove a front loader quickly and easily, as discussed above. But additionally, it is desirable to convert quickly and conveniently between these attachments to the front loader to effectively accommodate varying applications. U.S. Pat. No. 3,606,052, issued Sep. 20, 1971 in the name of James L. Schurz shows a typical prior art example of a front end loader in which the attachment is provided with a quick coupling device. This is one of the many examples of prior art mechanisms for quickly coupling attachments to front loaders.

In all known prior art apparatus of which applicants are aware there is no simple, convenient system for attaching and removing a front end loader in an effective manner without the use of tools. Even in those cases where loaders are removable and attachable there still exists the necessity of manually affixing a latch plate to securely hold the loader in place during operation. Likewise the plate must be manually removed when the loader is being detached adding a cumbersome step to the process. A known system of this nature is shown in "Installation Instructions Mount Kit

#9863872", catalog number 41645800, a 1996 publication issued by New Holland North America, Inc., assignee of the present application. FIG. 3 on page 3 shows a clamp, designated by reference numeral 1, that in manually affixed to the loader frame.

SUMMARY OF THE INVENTION

The principle object of the present invention is to provide loader coupling apparatus having a latching mechanism that is operative to automatically accomplish the clamping function of the above described prior art.

Another important object of the present invention is to provide loader coupling apparatus having a latching mechanism that is operative to automatically accomplish the clamping function of the above described prior art, which apparatus is adjustable to compensate for tolerances and wear.

In pursuance of these and other important objects the present invention is directed to improved apparatus for coupling a front end loader to a tractor. The apparatus includes a longitudinally extending loader mounting frame with means for pivotally supporting a pair of loader boom arms. The frame comprises a pair of transversely spaced support arms and a pair of forwardly extending members affixed to the support arms. A pair of front mounting pins extend from the tractor for supportably coupling the forwardly extending members of the frame. A pair of rear mounting pins, extending from the tractor, accommodate latch means for separately coupling each of the transversely spaced support arms to a corresponding one of the pair of rear mounting pins. The latch means include a notch in the support arm for receiving the mounting pin and means for holding the pin in the notch under conditions where the mounting pin is received by the notch. More specifically, the present invention contemplates an improvement comprising a latch plate pivotally mounted on the support arm for automatic movement between open and closed positions under conditions where the mounting pin is received by the notch, and translatable holding means movable from a disengaged position to an engaged position for holding the latch plate in the closed position.

The foregoing and other objects, features and advantages of the invention will appear more fully hereinafter from a consideration of the detailed description which follows, in conjunction with the accompanying sheets of drawings wherein one principal embodiment of the present invention is illustrated by way of example. It is to be expressly understood, however, that the drawings are for illustrative purposes and are not to be construed as defining the limits of the invention.

DESCRIPTION OF THE PREFERRED EMBODIMENT

Figure 1:
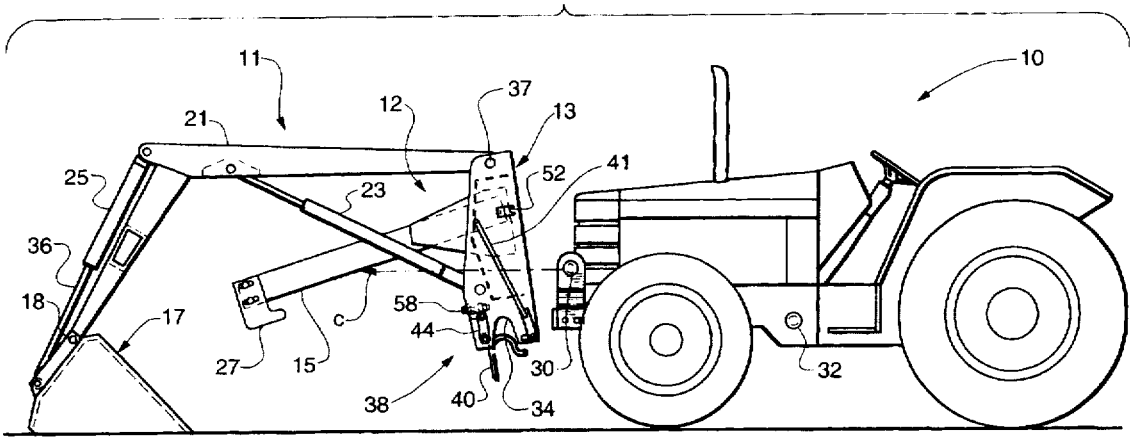
FIG. 1 is a side elevational view showing a tractor and front end loader in which the present invention is embodied.
Figure 2:
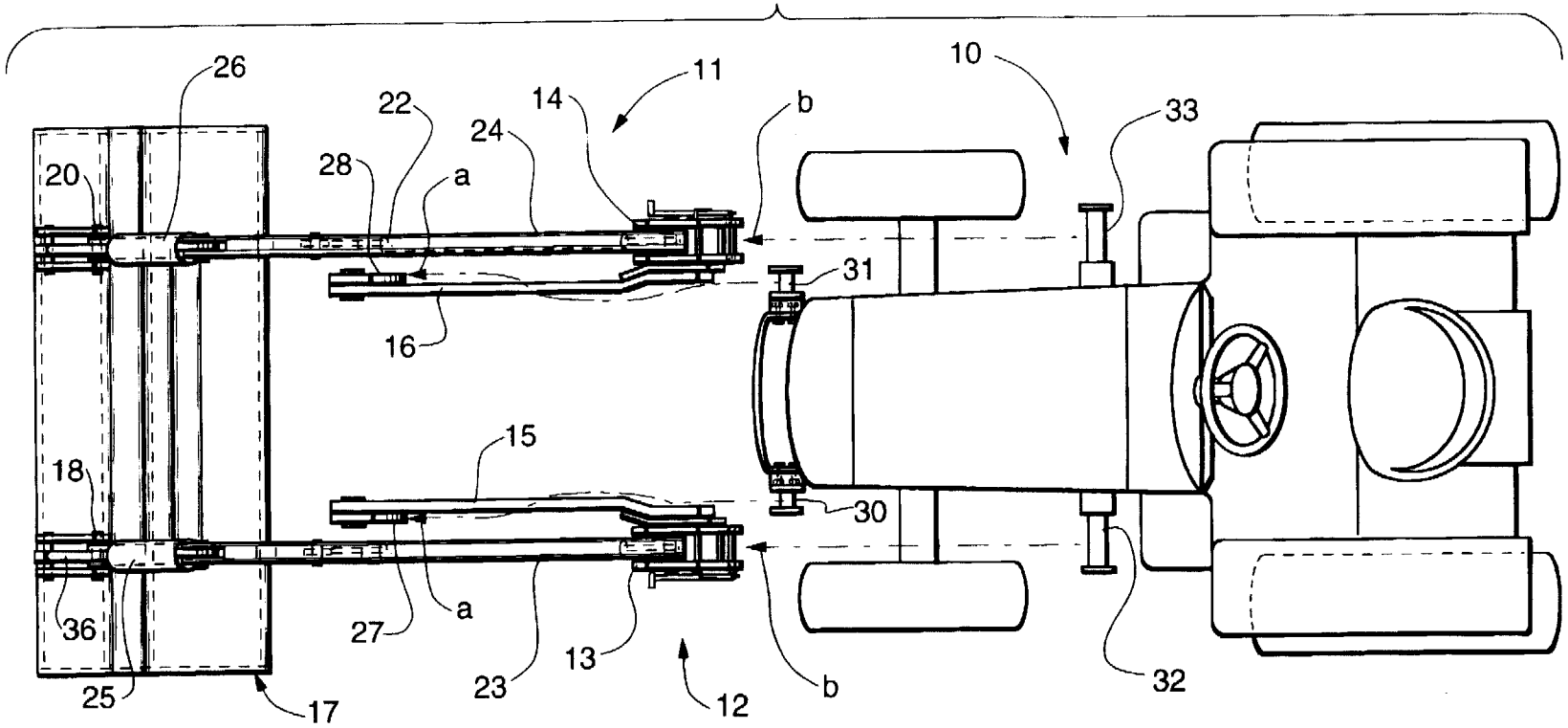
FIG. 2 is a plan view of the tractor and front end loader shown in FIG. 1.
Figure 3:
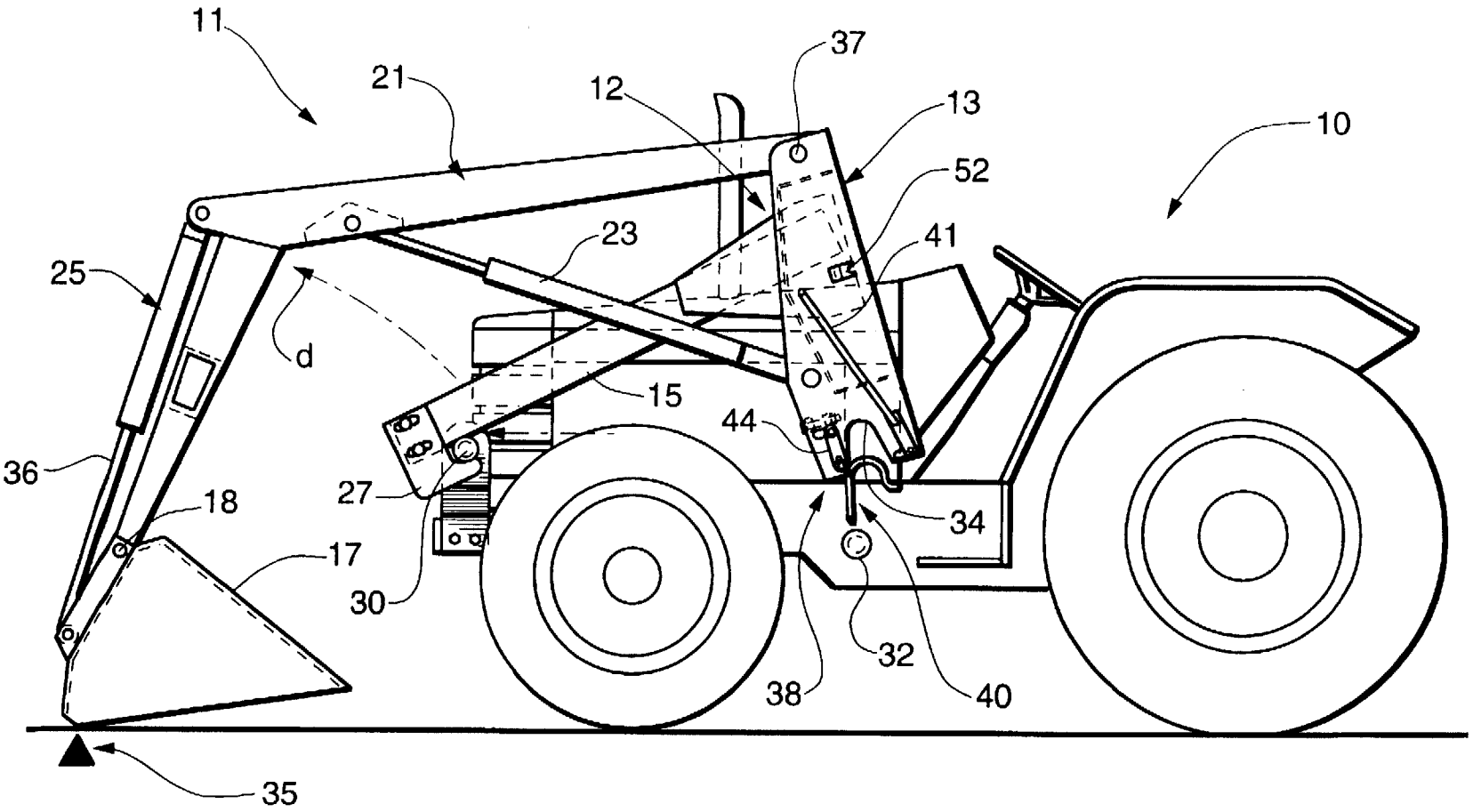
FIGS. 3–5 are side elevational views sequentially showing the relationship of the tractor and the front end loader as the loader is being mounted on the tractor.
Figure 4:
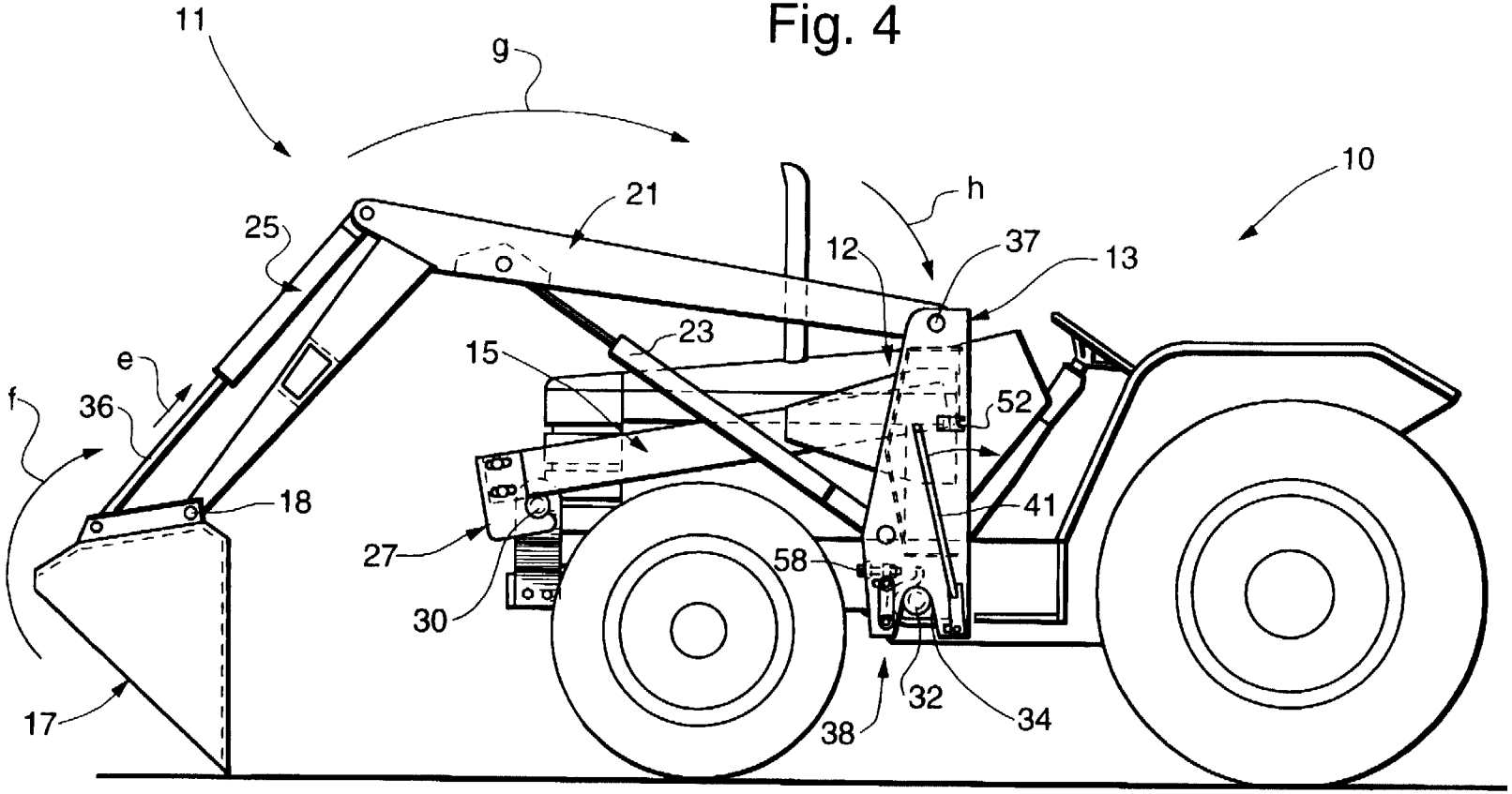

Referring now to the drawings for a more detailed description, FIG. 1 is a elevational view showing a tractor, generally designated by reference numeral 10, and a front end loader, generally designated by reference numeral 11, in which the coupling apparatus of the present invention is embodied. The loader is disposed forwardly of the tractor in a detached rest position, maintained by a suitable overhead hoist or a support stand (not shown). FIG. 2 is a plan view showing tractor 10 with loader 11 forwardly aligned in the FIG. 1 rest position.

Loader 11 comprises a mounting frame 12 having a pair of upright support arms 13, 14, to each of which is rigidly affixed a channel member 15, 16 extending forwardly therefrom. An attachment, such as a bucket 17, is pivotally supported at 18, 20 on a pair of boom arms 21, 22, both of which are pivotally mounted to the top of upright support arms 13, 14, respectively. Hydraulic boom lift cylinders 23, 24 extend from support arms 18, 20 to lift the boom arms in a conventional manner via the tractor powered hydraulic system. Likewise, bucket 17 is rotatable about pivots 18, 20 via activation of hydraulic cylinders 25, 26 extending between boom arms 21, 22 and bucket 17, which cylinders are also powered by the tractor hydraulic system.

Mounting hooks 27, 28, attached to the forward ends of channel members 15, 16, are adapted to cooperate with front mounting pins 30, 31, respectively, extending outwardly from tractor 10. As illustrated by arrows a, a in FIG. 2, hooks 27, 28 are laterally spaced the same distance as pins 30, 31. Rear mounting pins 32, 33 extend from the mid frame area of the tractor to accommodate notches 34 (only one shown) in the bottom of support arms 13, 14. Arrows b, b in FIG. 2 illustrate this general spacial relationship, which will be discussed in further detail below, i.e., rear pins are laterally spaced the same distance as notches 34 in upright support arms 13, 14.

Figure 5:
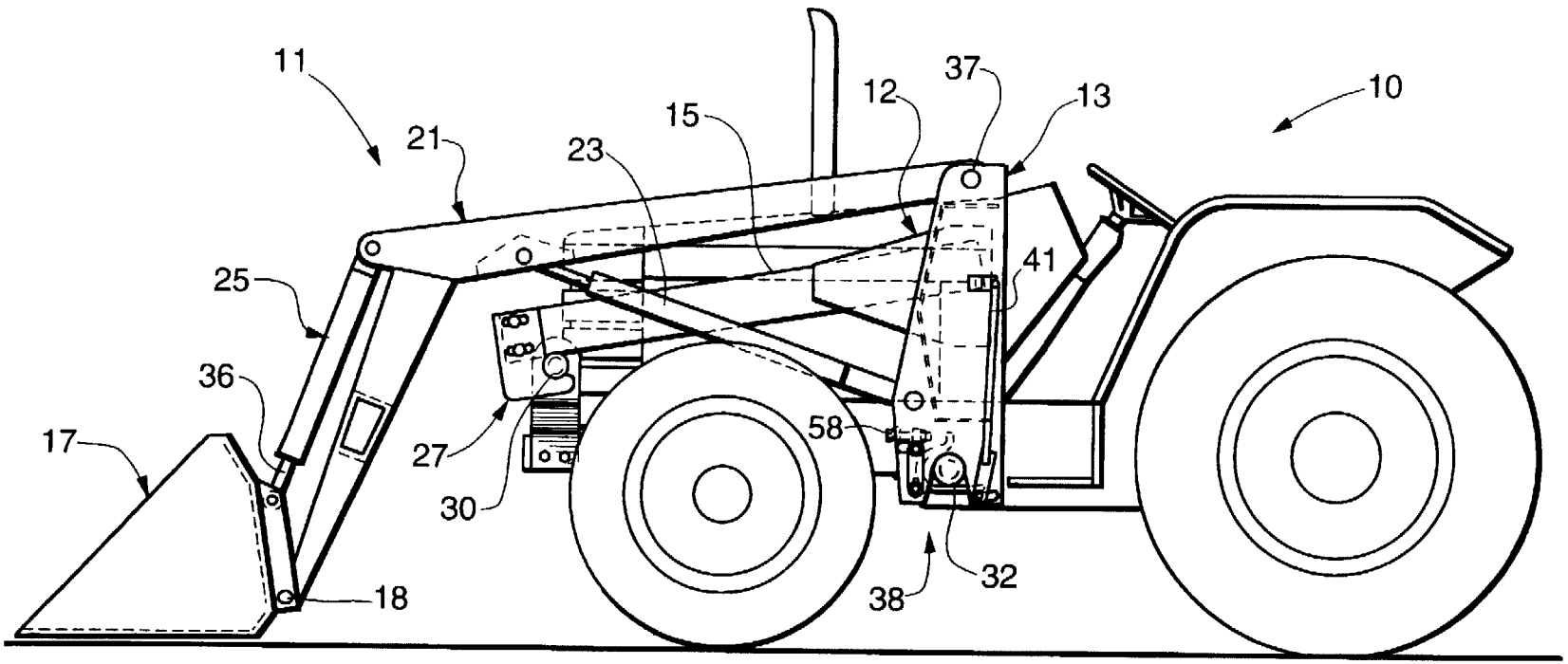
Figure 7:
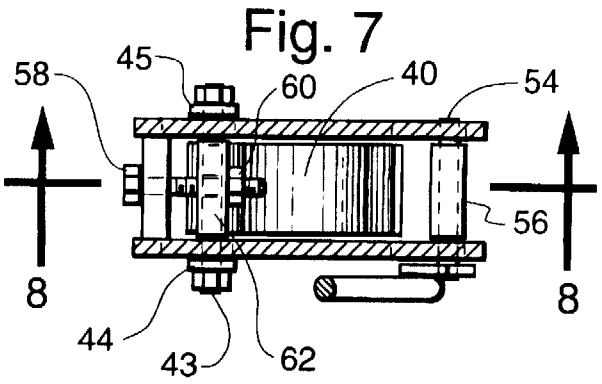
FIG. 7 is a sectional view taken in the direction of arrows 7—7 in FIG. 6.

Referring now to FIGS. 1 and 3–5, the coupling of front end loader 17 to tractor 10 will be described in general. In FIG. 1, as mentioned above, loader 11 is initially maintained in its decoupled rest position by a readily detachable stand or overhead hoist. The tractor is first driven toward loader 11 with front mounting pins 30, 31 moving in direction c, only one shown in FIG. 1, until they engage the bottom of channel members 15, 16. As the tractor continues to be driven forward the pins lift frame 12 as they slide along the bottom of channel members 15, 16. Thus, frame 12 is effectively pivoted counter clockwise in the direction of arrow d (FIG. 3) until forward pins nest in hooks 27, 28 as bucket 17 pivots about point 35. By retracting rod 36 of cylinder 25, (see arrow e in FIG. 4) bucket 17 rotates clockwise (arrow f) which rotates frame 12 about pins 37 (only one shown) in clockwise direction (arrow g) and moves support arms 13, 14 downwardly, arrow h, to seat rear mounting pins 32, 33 in corresponding notches 34 of support arms 13, 14. During this process a latch assembly 38 on each support arm automatically moves from open to closed position. To this end a latch plate 40 is moved from an open position shown in FIGS. 1 and 3 to a closed position shown in FIGS. 4 and 5, whereupon latch handle 41 is moved to the position shown in FIG. 5 to hold latch plate 38 in place, the details of which are discussed below. It should be noted that FIG. 5 shows the boom arms 21, 22 of loader 11 lowered to a convenient work position by cylinders 23, 24 and bucket 17 rotated to its operative position by cylinders 25, 26.

Now turning to FIGS. 6–9 for a detailed description of latch assembly 38, latch plate 40 is pivotally mounted by pivot assembly 42 for free rotation about latch pivot pin 43 extending between opposing adjustment plates 44, 45. Latch pivot pin 43 is journalled in a rigid collar 46 welded to latch plate 40. Latch plate 40, further comprising a flange portion 47 and an integral bight portion 48, is shown in the open position in the solid lines of FIGS. 6 and 8, i.e., flange 47 is generally vertical and bight portion 48 is facing downwardly to receive mounting pin 32. Bight portion 48 is configured with a surface having a radius adapted to readily receive pin 32, whereupon the latch plate 40 pivots counterclockwise about pivot assembly 42 under conditions where mounting pin 32 engages bight portion 48. As support arms 13, 14 are lowered, the downwardly facing portion 50 of notch 34 eventually rests on mounting pin 32, as shown in phantom outline in FIG. 6. Latch plate 40 has rotated to the closed position by virtue of contact with mounting pin 32, which closed position of latch plate is also shown in phantom outline in FIG. 6.

Figure 9:
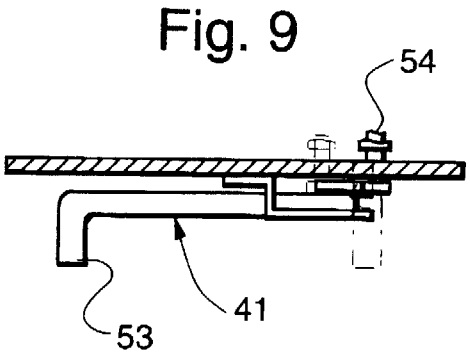
FIG. 9 is an enlarged detail view taken in the direction of arrows 9—9 in FIG. 6.
Figure 8:
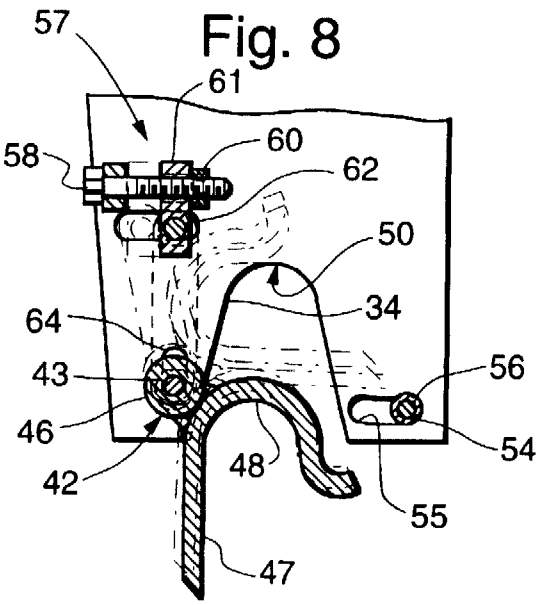
FIG. 8 is a sectional view taken in the direction of arrows 8—8 in FIG. 7.
Figure 6:
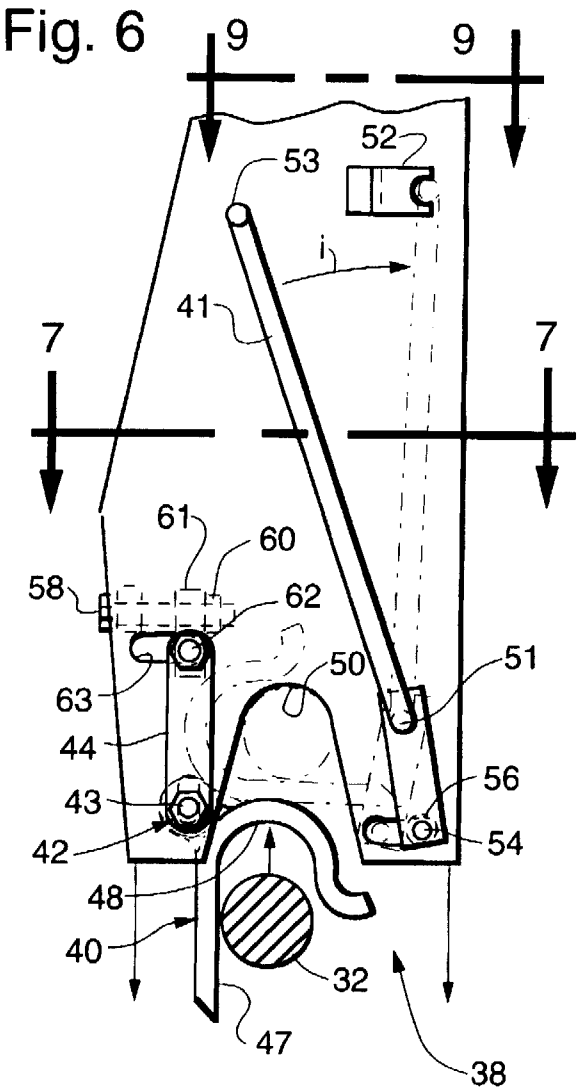
FIG. 6 is an enlarged partial side elevational view showing the latching mechanism of the present invention.

To hold latch plate 40 closed, latch handle 41 is pivoted about pivot 51 to the position shown in phantom outline in FIGS. 6 and 9 and held by keeper 52, as illustrated by arrow i. Latch handle 41 is flexed outwardly to clear the keeper thereby permitting handle knob 53 to seat in an accommodating notch when it returns to its normal non-flexed condition. In the holding position a rod 54, which has been moved from right to left in slot 55, moves coaxial sleeve 56 below flange 47 of latch plate 40, and thereby prevents latch plate 40 from dropping to its open position.

In the closed position, latch plate 40 can be adjusted vertically relative to notch 34 by latch plate adjusting assembly 57. An adjusting bolt 58 is rotated in traveling nut 60 which moves slider 61 along the shank of bolt 58. This moves a pin 62, extending through adjustment plates 44, 45, along slot 63 which causes pivot pin 43 disposed at the distal end of plates 44, 45, to be translated vertically along slot 64. This adjustment is diagrammatically depicted in FIG. 8 by the two phantom outlines showing the position limits established by of adjustment of the latch plate.

Of the many implicit and explicit advantages of the present invention one of the most important is the provision of a self closing latching mechanism that moves automatically from open to closed position and vise versa without requiring the use of tools. Further, the latch plate is adjustable to provide a snug fit regardless of variances in tolerances and to accommodate for wear under conditions where a loose fits is not acceptable.

While preferred structure in which the principles of the present invention are shown and described above, it is to be understood that the invention is not limited to such structure, but that, in fact, widely different means of varying scope and configuration may be employed in the practice of the invention.

Having thus described the invention, what is claimed is:

1. In an apparatus for coupling a front end loader to a tractor comprising a longitudinally extending loader mounting frame, means for pivotally supporting a pair of loader boom arms on said frame, said frame comprising a pair of transversely spaced support arms, and a pair of forwardly extending members affixed to said support arms, a pair of front mounting pins extendable from said tractor, means for coupling said forwardly extending members to said front mounting pins, a pair of rear mounting pins extendable from said tractor, and latch means for separately coupling each of said transversely spaced support arms to a corresponding one of said pair of rear mounting pins, said latch means including a notch in each said support arm for receiving one of said rear mounting pins and means for holding each said rear mounting pin in its notch under conditions where each said rear mounting pin is received by its notch, the improvement comprising a latch plate pivotally mounted on each said support arm for automatic movement between open and closed positions under conditions where each said rear mounting pin is received by its notch, translatable holding means mounted on said pair of transversely spaced support arms and movable from a disengaged position to an engaged position for holding each said latch plate in said closed position, and a latch handle coupled to said translatable holding means for remotely effecting movement of said translatable holding means from said disengaged position to said engaged position.

2. In an apparatus for coupling a front end loader to a tractor comprising a longitudinally extending loader mounting frame, means for pivotally supporting a pair of loader boom arms on said frame, said frame comprising a pair of transversely spaced support arms, and a pair of forwardly extending members affixed to said support arms, a pair of front mounting pins extendable from said tractor, means for coupling said forwardly extending members to said front mounting pins, a pair of rear mounting pins extendable from said tractor, and latch means for separately coupling each of said transversely spaced support arms to a corresponding one of said pair of rear mounting pins, said latch means including a notch in each said support arm for receiving one of said rear mounting pins and means for holding each said rear mounting pin in its notch under conditions where each said rear mounting pin is received by its notch, the improvement comprising a latch plate pivotally mounted on each said support arm for automatic movement between open and closed positions under conditions where each said rear mounting pin is received by its notch, translatable holding means mounted on said pair of transversely spaced support arms and movable from a disengaged position to an engaged position for holding each said latch plate in said closed position, said notch in each said support arm includes a downwardly facing arcuate portion corresponding in configuration to the top of its respective rear mounting pin for engaging its respective rear mounting pin under conditions where its respective rear mounting pin is received by its notch, each said latch plate includes a flange portion that extends generally horizontally below its respective rear mounting pin under conditions where each said latch plate has been moved to its closed position, said translatable holding means includes a rod disposed in the engaged position below each said flange portion under conditions where each said latch plate has been moved to its closed position.

3. In the apparatus as set forth in claim 2 wherein said improvement further comprises means for adjusting the position of each said flange relative to its rear mounting pin under conditions where its latch plate has been moved to its closed position, said means for adjusting mounted on said pair of transversely spaced support arms.

4. In the apparatus as set forth in claim 3 wherein each said latch plate includes pivot means, and said adjusting means include means mounted on each said support arm for selectively positioning its pivot means relative to said downwardly facing arcuate portion of its notch.

5. Apparatus for coupling a front end loader to a tractor comprising in combination a longitudinally extending loader mounting frame, means for pivotally supporting a pair of loader boom arms on said frame, said frame comprising a pair of transversely spaced support arms, and a pair of forwardly extending members affixed to said support arms, a pair of front mounting elements mountable on said tractor for supporting said frame, means for coupling said forwardly extending members to said front mounting elements, a pair of rear mounting pins extendable from said tractor for supporting said frame, and latch means for separately coupling each of said transversely spaced support arms to a corresponding one of said pair of rear mounting pins under conditions where said forwardly extending members are coupled to said front mounting elements, said latch means including a notch in each said support arm for receiving one of said rear mounting pins and means for holding each said rear mounting pin in its notch under conditions where each said rear mounting pin is received by its notch, a latch plate pivotally mounted on each said support arm for automatic movement between open and closed positions under conditions where each said rear mounting pin is received by its notch, translatable holding means mounted on said pair of transversely spaced support arms and movable from a disengaged position to an engaged position for holding each said latch plate in said closed position, and a latch handle coupled to said translatable holding means for remotely effecting movement of said translatable holding means from said disengaged position to said engaged position.

6. Apparatus for coupling a front end loader to a tractor comprising in combination a longitudinally extending loader mounting frame, means for pivotally supporting a pair of loader boom arms on said frame, said frame comprising a pair of transversely spaced support arms, and a pair of forwardly extending members affixed to said support arms, a pair of front mounting elements mountable on said tractor for supporting said frame, means for coupling said forwardly extending members to said front mounting elements.

a pair of rear mounting pins extendable from said tractor for supporting said frame, and latch means for separately coupling each of said transversely spaced support arms to a corresponding one of said pair of rear mounting pins under conditions where said forwardly extending members are coupled to said front mounting elements, said latch means including a notch in each said support arm for receiving one of said rear mounting pins and means for holding each said rear mounting pin in its notch under conditions where each said rear mounting pin is received by its notch, a latch plate pivotally mounted on each said support arm for automatic movement between open and closed positions under conditions where each said rear mounting pin is received by its notch, and translatable holding means mounted on said pair of transversely spaced support arms and movable from a disengaged position to an engaged position for holding each said latch plate in said closed position, said notch in each said support arm includes a downwardly facing arcuate portion corresponding in configuration to the top of its respective rear mounting pin for engaging its respective rear mounting pin under conditions where its respective rear mounting pin is received by its notch, each said latch plate includes a flange portion that extends generally horizontally below its respective rear mounting pin under conditions where each said latch plate has been moved to its closed position, said translatable holding means includes a rod disposed in the engaged position below each said flange portion under conditions where each said latch plate has been moved to its closed position.

7. Apparatus as set forth in claim 6 wherein said combination further comprises means for adjusting the position of each said flange relative to its rear mounting pin under conditions where its latch plate has been moved to its closed position, said means for adjusting mounted on swed pair of transversely spaced support arms.

8. Apparatus as set forth in claim 7 wherein each said latch plate includes pivot means, and said adjusting means include means mounted on each said support arm for selectively positioning its pivot means relative to said downwardly facing arcuate portion of its notch.

9. In an apparatus for coupling a front end loader to a tractor comprising a longitudinally extending loader mounting frame, means for pivotally supporting a pair of loader boom arms on said frame, said frame comprising a pair of transversely spaced support arms, and a pair of forwardly extending members affixed to said support arms, a pair of front mounting pins extendable from said tractor, means for coupling said forwardly extending members to said front mounting pins, a pair of rear mounting pins extendable from said tractor, and latch means for separately coupling each of said transversely spaced support arms to a corresponding one of said pair of rear mounting pins, said latch means including a notch in each said support arm for receiving one of said rear mounting pins and means for holding each said rear mounting pin in its notch under conditions where each said rear mounting pin is received by its notch, the improvement comprising a latch plate pivotally mounted on each said support arm for automatic movement between open and closed positions under conditions where each said rear mounting pin is received by its notch, translatable holding means mounted on said pair of transversely spaced support arms and movable from a disengaged position to an engaged position for holding each said latch plate in said closed position, said notch in each said support arm includes a downwardly facing arcuate portion corresponding in configuration to the top of its respective rear mounting pin for engaging its respective rear mounting pin under conditions where its respective rear mounting pin is received by its notch, each said latch plate includes a flange portion that extends generally horizontally below its respective rear mounting pin under conditions where each said latch plate has been moved to its closed position, each said latch plate further includes a bight portion contiguous with its flange portion, each said bight portion faces downwardly below its respective notch under conditions where said latch plate is in said open position, and each said bight portion is adapted to engage its respective rear mounting pin and pivot said latch plate to its closed position as said rear mounting pin is being received by its notch.

10. Apparatus for coupling a front end loader to a tractor comprising in combination a longitudinally extending loader mounting frame, means for pivotally supporting a pair of loader boom arms on said frame, said frame comprising a pair of transversely spaced support arms, and a pair of forwardly extending members affixed to said support arms, a pair of front mounting elements mountable on said tractor for supporting said frame, means for coupling said forwardly extending members to said front mounting elements, a pair of rear mounting pins extendable from said tractor for supporting said frame, and latch means for separately coupling each of said transversely spaced support arms to a corresponding one of said pair of rear mounting pins under conditions where said forwardly extending members are coupled to said front mounting elements, said latch means including a notch in each said support arm for receiving one of said rear mounting pins and means for holding each said rear mounting pin in its notch under conditions where each said rear mounting pin is received by its notch, a latch plate pivotally mounted on each said support arm for automatic movement between open and closed positions under conditions where each said rear mounting pin is received by its notch, and translatable holding means mounted on said pair of transversely spaced support arms and movable from a disengaged position to an engaged position for holding each said latch plate in said closed position.

said notch in each said support arm includes a downwardly facing arcuate portion corresponding in configuration to the top of its respective rear mounting pin for engaging its respective rear mounting pin under conditions where its respective rear mounting pin is received by its notch.

each said latch plate includes a flange portion that extends generally horizontally below its respective rear mounting pin under conditions where each said latch plate has been moved to its closed position.

each said latch plate further includes a bight portion contiguous with its flange portion.

each said bight portion faces downwardly below its respective notch under conditions where said latch plate is in said open position.

each said bight portion is adapted to engage its respective rear mounting pin and pivot said latch plate to its closed position as said rear mounting pin is being received by its notch.

* * * * *